US008132491B2

(12) United States Patent
Real et al.

(10) Patent No.: US 8,132,491 B2
(45) Date of Patent: Mar. 13, 2012

(54) METHOD AND APPARATUS FOR DETECTING AND DISABLING OPTICAL WEAPON SIGHT

(75) Inventors: Edward C. Real, Nashua, NH (US); Paul D. Zemany, Amherst, NH (US); Paul A. Zank, Brookline, NH (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 1222 days.

(21) Appl. No.: 11/451,114

(22) Filed: Jun. 12, 2006

(65) Prior Publication Data

US 2008/0295677 A1 Dec. 4, 2008

(51) Int. Cl.
*B64D 1/04* (2006.01)

(52) U.S. Cl. ..... 89/1.11; 42/1.08; 250/526

(58) Field of Classification Search ..... 89/1.11; 42/1.08

See application file for complete search history.

(56) References Cited

U.S. PATENT DOCUMENTS 3,946,233 A * 3/1976 Erben et al. ..... 250/347
4,765,244 A * 8/1988 Spector et al. ..... 102/213
4,836,672 A * 6/1989 Naiman et al. ..... 356/5.06
5,604,588 A * 2/1997 Goedert ..... 356/318
5,612,503 A * 3/1997 Sepp ..... 89/1.11
5,747,720 A * 5/1998 Schnurr et al. ..... 89/1.11
6,603,134 B1 * 8/2003 Wild et al. ..... 250/526
7,202,809 B1 * 4/2007 Schade et al. ..... 342/67
7,232,240 B2 * 6/2007 Kosnik et al. ..... 362/259
7,400,287 B2 * 7/2008 Saccomanno ..... 342/12
RE40,927 E * 10/2009 Wild et al. ..... 250/526
7,692,126 B2 * 4/2010 Aragones et al. ..... 244/3.1
7,768,444 B1 * 8/2010 Rourk ..... 342/67

* cited by examiner

*Primary Examiner* — Michael Carone
*Assistant Examiner* — Samir Abdosh
(74) *Attorney, Agent, or Firm* — Daniel J. Long

(57) ABSTRACT

The present invention is an apparatus for detecting and disabling a human eye or optical device used in the fire control of a weapon. This apparatus comprises a prism having a plurality of peripheral reflective surface. This prism has a longitudinal axis and rotating about said longitudinal axis. An infrared (IR) laser directs an infrared laser beam toward the prism side that the laser beam is reflected toward the human eye or optical device, such that the IR laser beam is retroreflected to the prism. There is also an infrared IR detector which detects the IR retroreflected laser beam reflected from the prism. A visible light wavelength laser which produces a visible light wavelength laser beam which is reflected from the prism to the human eye or optical device to disable the human eye or optical device to prevent use of the weapon.

17 Claims, 3 Drawing Sheets

METHOD AND APPARATUS FOR DETECTING AND DISABLING OPTICAL WEAPON SIGHT

BACKGROUND OF THE INVENTION

1. Field of the Invention

The present invention relates to ordnance and, more particularly, to countermeasures against ordnance.

2. Brief Description of Prior Developments

In the use of ordnance a target is often sighted by means of an optical device. There would be advantages in defending against such ordnance in being able to detect and dazzle such optical devices.

A need, therefore, exists for an improved means of detecting and dazzling such optical devices.

SUMMARY OF INVENTION

The present invention is an apparatus for detecting and disabling a human eye or optical device used in the fire control of a weapon. This apparatus comprises a prism having a plurality of peripheral reflective surface. This prism has a longitudinal axis and rotating about said longitudinal axis. An infrared (IR) laser directs an infrared laser beam toward the prism side that the laser beam is reflected toward the human eye or optical device, such that the IR laser beam is retroreflected to the prism. There is also an infrared IR detector which detects the IR retroreflected laser beam reflected from the prism. A visible light wavelength laser which produces a visible light wavelength laser beam which is reflected from the prism to the human eye or optical device to disable the human eye or optical device to prevent use of the weapon.

The present invention also a method for detecting and disabling a human eye or optical device used in the fire control of a weapon. In this method the human eye or optical device is detected by retroreflecting electromagnetic radiation outside of the visible spectrum from the human eye or optical devices. The human eye or optical device is then disabled by directing electromagnetic radiation toward said human eye or optical device.

BRIEF DESCRIPTION OF THE DRAWINGS

The present invention is further described with reference to the accompanying drawings wherein.

DETAILED DESCRIPTION OF THE PREFERRED EMBODIMENT

Figure 1:
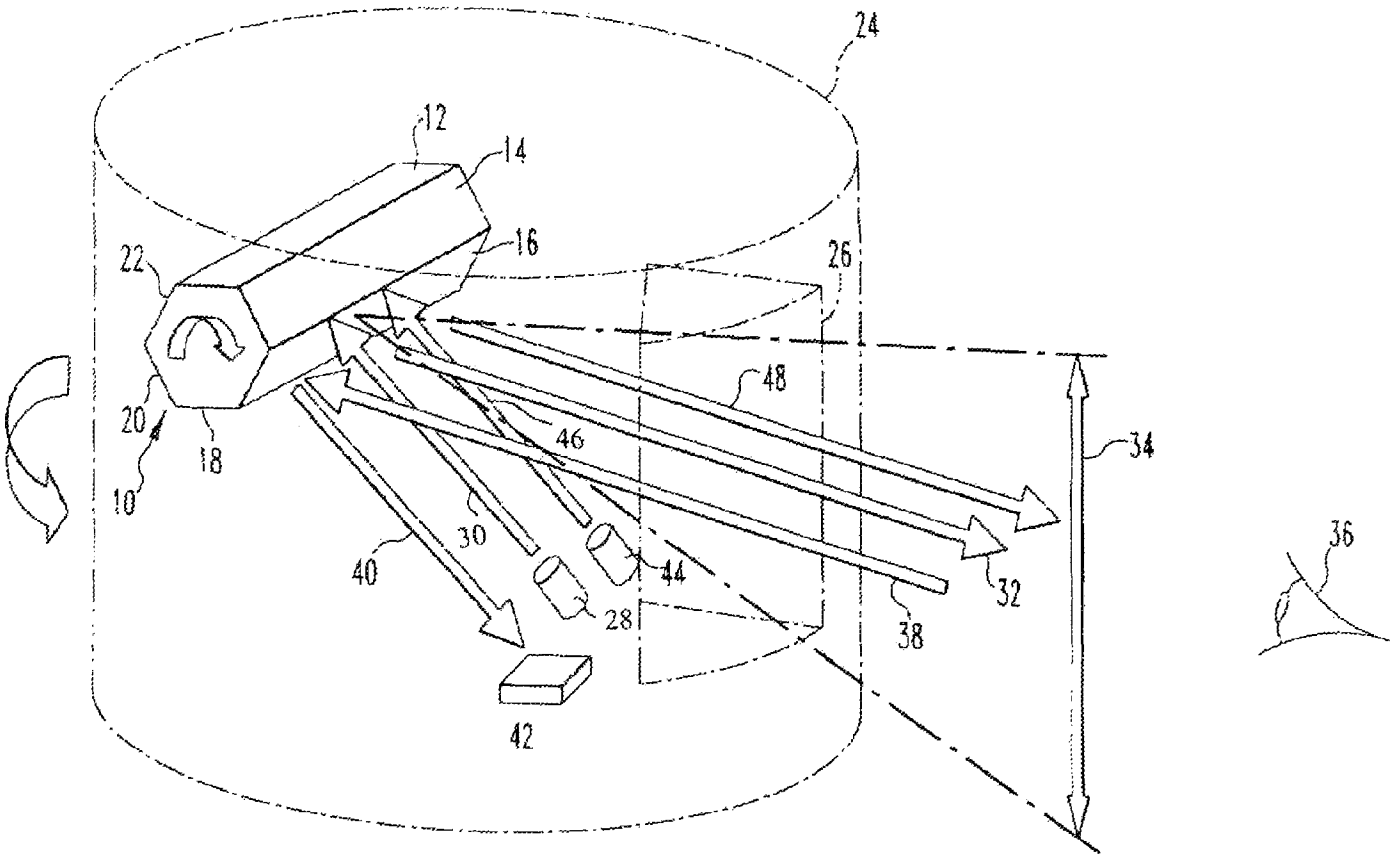
FIG. 1 is a perspective drawing showing a preferred embodiment of the laser detector and dazzler apparatus of the present invention.

Referring to FIG. 1, the laser detector and dazzler apparatus of the present invention includes a hexagonal cross section prism 10 having an aluminum or gold plated sides 12, 14, 16, 18 20, and 22. The prism 10 rotates about its longitudinal axis and it is mounted inside a housing 24. There is an elongated vertical aperture 26 in the housing 24. Also positioned inside the housing 24, there is an infrared (IR) laser 28 which produces an IR beam 30 which is reflected from one of the sides as at side 16 to produce an IR retro detector beam 32. As a result of the rotating prism 10 and the vertical elongated aperture 26, there is an elevation scan angle 34

The IR detector beam 32 is received by a human eye or optical device 36. A beam 38 is retroflexed from the human eye or optical device 36 back to side 16 of the rotating prism 10 from where it is reflected back to the IR detector 42. When a human eye or optical device 36 is detected, the laser 44 is signaled to produce a green light laser beam 46 which is reflected from side 16 of the rotating prism 10 in the green laser dazzler beam 48 to the human eye or optical device 36 which is then dazzled so as to be incapacitated.

Figure 2:
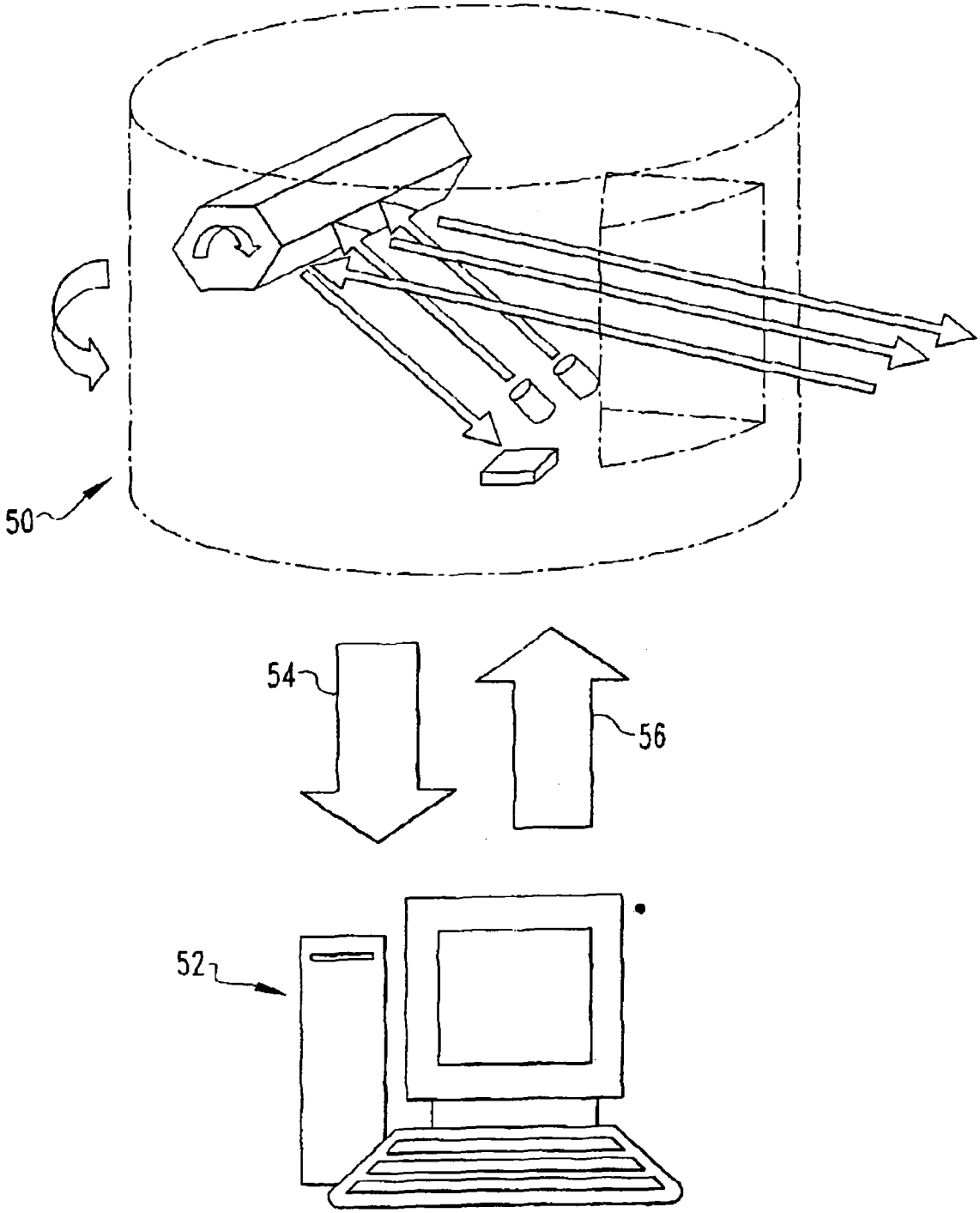
FIG. 2 is a schematic drawing illustrating a preferred embodiment of the method of the present application.

Referring to FIG. 2, the laser apparatus 50 of the present invention would be used with a computer 52. Azimuth, elevation and range data from "retro" returns 54 to be transmitted from the laser apparatus 50 to the computer 52. The computer 52 could perform clutter suppression and target detection from "retro," as well as provide azimuth, elevational and range and/or power computations back to the transmitter to be transmitted 56 to the apparatus 50.

Figure 3:
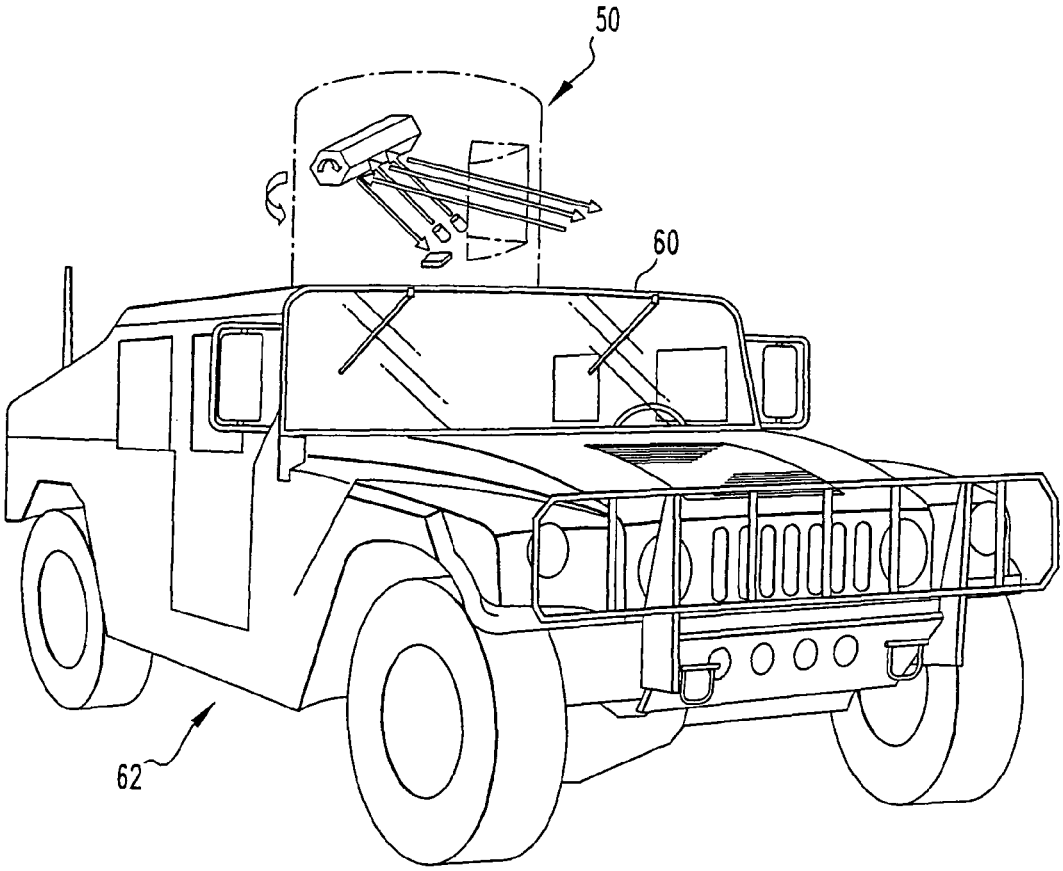
FIG. 3 is a perspective drawing showing a preferred embodiment of the laser detector and dazzler shown in FIG. 1 mounted on a vehicle.

Referring to FIG. 3, in operating the laser apparatus 50 may be mounted on the roof 60 of a vehicle 62 such as HUMVEE® style vehicle. If a weapon is trained on the vehicle 62, the laser apparatus 50 is used to detect and dazzle and thereby disable a human eye or other optical device used in conjunction with the weapon.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. An apparatus for detecting and disabling a human eye or optical device used in fire control of a weapon comprising:

a prism having a plurality of peripheral reflective surfaces, said prism having a longitudinal axis and rotating about said longitudinal axis;

an infrared (IR) laser directing an infrared laser beam toward the prism, said IR laser beam being reflected from the prism toward a human eye or optical device, such that said IR laser beam is retroreflected to the prism;

an infrared IR detector which detects the IR retroreflected laser beam reflected from the prism; and a visible light wavelength laser which produces a visible light wavelength laser beam which is reflected from the prism to the human eye or optical device to disable said human eye or optical device to prevent use of the weapon.

2. The apparatus of claim 1 wherein the prism, IR detector, IR laser and visible light wavelength laser are positioned inside a housing having an aperture through which the IR laser beam and the visible wavelength laser beam are reflected.

3. The apparatus of claim 1 wherein the aperture in the housing is an elongated vertical aperture.

4. The apparatus of claim 1 wherein the visible light wavelength laser is a green light laser.

5. The apparatus of claim 2 wherein the housing rotates about its vertical axis.

6. A method for detecting and disabling a human eye or optical device used in fire control of a weapon comprising the steps of:

rotating an elongated prism along a longitudinal axis;

reflecting electromagnetic radiation from at least one side of the elongated prism toward a human eye or optical device;

detecting a human eye or optical device by retroreflecting electromagnetic radiation outside of the visible spectrum from the human eye or optical device; and disabling the human eye or optical device by directing electromagnetic radiation toward said human eye or optical device.

7. The method of claim 6 wherein the human eye or optical device is detected by means of infrared IR light.

8. The method of claim 6 wherein the human eye or optical device is detected by means of an IR laser.

9. The method of claim 7 wherein the human eye or optical device is disabled by means of a visible light laser.

10. The method of claim 9 wherein the visible light laser is a green light laser.

11. An apparatus for detecting and disabling a human eye or optical device used in fire control of a weapon comprising:

a prism having a plurality of metal coated peripheral reflective surfaces, said prism having a longitudinal axis and rotating about said longitudinal axis;

an infrared (IR) laser directing an infrared laser beam toward the prism, said IR laser beam being reflected from the prism toward a human eye or optical device, such that said IR laser beam is retroreflected to the prism;

an infrared IR detector which detects the IR retroreflected laser beam reflected from the prism; and a visible light wavelength laser which produces a visible light wavelength laser beam which is reflected from the prism to the human, eye or optical device to disable said human eye or optical device to prevent use of the weapon.

12. The method of claim 6, wherein the electromagnetic radiation is an infrared (IR) laser beam.

13. The apparatus of claim 11, wherein the metal coating is made of gold.

14. The apparatus of claim 11, wherein the metal coating is made of aluminum.

15. The apparatus of claim 11, wherein the human eye or optical device is detected by means of infrared IR light.

16. The apparatus of claim 11, wherein the human eye or optical device is detected by means of an IR laser.

17. The apparatus of claim 11, wherein the human eye or optical device is disabled by means of a visible light laser.

* * * * *